US010320158B2

(12) United States Patent
Imai

(10) Patent No.: US 10,320,158 B2
(45) Date of Patent: Jun. 11, 2019

(54) SPARK PLUG

(71) Applicant: NGK Spark Plug Co., LTD., Nagoya (JP)

(72) Inventor: Susumu Imai, Komaki (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/453,565

(22) Filed: Mar. 8, 2017

(65) Prior Publication Data

US 2017/0288372 A1 Oct. 5, 2017

(30) Foreign Application Priority Data

Mar. 29, 2016 (JP) ..... 2016-064995

(51) Int. Cl.
*H01T 13/39* (2006.01)
*H01T 13/32* (2006.01)

(52) U.S. Cl.
CPC ..... *H01T 13/39* (2013.01); *H01T 13/32* (2013.01)

(58) Field of Classification Search
CPC ..... H01T 13/39; H01T 13/20; H01T 13/32; H01T 21/02
See application file for complete search history.

(56) References Cited

U.S. PATENT DOCUMENTS 6,533,628 B1 * 3/2003 Matsutani ..... H01T 21/02 219/121.64
2007/0114899 A1 * 5/2007 Lykowski ..... H01T 13/20 313/141
2008/0238282 A1 * 10/2008 Kato ..... H01T 13/32 313/142
2010/0242888 A1 * 9/2010 Torii ..... H01T 13/39 123/169 E (Continued)

FOREIGN PATENT DOCUMENTS

CN 103579907 A 2/2014
JP 2009-163923 A 7/2009

(Continued)

OTHER PUBLICATIONS

Office Action dated Jan. 23, 2018 for the corresponding Japanese Patent Application No. 2016-064995.

(Continued)

*Primary Examiner* — Mariceli Santiago
(74) *Attorney, Agent, or Firm* — Leason Ellis LLP

(57) ABSTRACT

A spark plug includes an insulator having an axial hole extending along an axial line, a center electrode disposed in the axial hole, a tubular metallic shell surrounding the insulator, a ground electrode whose proximal end is fixed to the metallic shell, and a cylindrical noble metal tip fixed to the ground electrode via an intermediate tip so as to form a gap between the noble metal tip and the center electrode. A weld portion is provided between the noble metal tip and the intermediate tip. The weld portion has a diameter larger than (Continued)

that of a portion of the intermediate tip which is adjacent to the weld portion. The noble metal tip is located inside a virtual tapered cylindrical surface which extends from a peripheral edge of a gap-side end of the center electrode so as to contact an outer circumferential edge of the weld portion.

11 Claims, 3 Drawing Sheets

(56) References Cited

U.S. PATENT DOCUMENTS

2011/0043093 A1* 2/2011 Nunome ..... H01T 13/39 313/141
2011/0193471 A1* 8/2011 Kato ..... H01T 13/20 313/141
2013/0069516 A1* 3/2013 Sumoyama ..... H01T 13/39 313/141
2014/0011417 A1* 1/2014 Ichihara ..... H01T 21/02 445/4
2014/0042893 A1 2/2014 Sakakura et al.
2017/0125981 A1* 5/2017 Suzuki ..... H01T 13/39

FOREIGN PATENT DOCUMENTS

JP 2010-086758 A 4/2010
JP 2011-258510 A 12/2011
JP 2015-159000 A 9/2015
WO WO 2009063930 A1 * 5/2009

OTHER PUBLICATIONS

Second Office Action dated Jan. 9, 2019 for the corresponding Chinese Patent Application No. 201710150666.9.

* cited by examiner

SPARK PLUG

This application claims the benefit of Japanese Patent Application No. 2016-064995, filed Mar. 29, 2016, which is incorporated herein in its entirety by reference.

FIELD OF THE INVENTION

The present invention relates to a spark plug.

BACKGROUND OF THE INVENTION

Conventionally, in order to improve durability and ignition performance of a spark plug, a noble metal tip has been joined to a center electrode or a ground electrode (see, for example, Japanese Patent Application Laid-Open (kokai) No. 2015-159000).

Problems to be Solved by the Invention

However, in the case where a spark plug having a noble metal tip is used for an internal combustion engine in which the flow velocity of an air-fuel mixture in a cylinder is high, such as a highly supercharged internal combustion engine or a direct injection internal combustion engine, sparks may fly directly to a center electrode or a ground electrode (hereinafter, collectively referred to as an "electrode component"), rather than to the noble metal tip, due to flowing of sparks. If sparks fly directly to the electrode component, the electrode component may be worn out, leading to decrease in durability of the spark plug. Accordingly, there has been a need for a technique applied to a spark plug having a noble metal tip so as to restrain flying of sparks directly to an electrode component of the spark plug.

SUMMARY OF THE INVENTION

Means for Solving the Problems

The present invention has been accomplished in order to solve the above-mentioned problem, and can be realized as the following modes.

(1) A spark plug according to one mode of the present invention comprises an insulator having an axial hole extending along an axial line of the spark plug; a center electrode disposed in the axial hole; a tubular metallic shell surrounding the insulator; a ground electrode whose proximal end is fixed to the metallic shell; and a cylindrical noble metal tip which is fixed to the ground electrode via an intermediate tip so as to form a gap between the noble metal tip and the center electrode, wherein a weld portion is provided between the noble metal tip and the intermediate tip. In the spark plug, the weld portion has a diameter larger than that of a portion of the intermediate tip which is adjacent to the weld portion, and the noble metal tip is located inside a virtual tapered cylindrical surface which extends from a peripheral edge of a gap-side end of the center electrode so as to contact an outer circumferential edge of the weld portion. According to the spark plug of this mode, the weld portion between the noble metal tip and the intermediate tip has a large diameter. As a result, flying of sparks directly to the ground electrode, which is an electrode component, can be restrained.

(2) In the spark plug of the above-described mode, over the entirety of a circumference of the weld portion, the diameter of the weld portion may be larger than the diameter of the portion of the intermediate tip which is adjacent to the weld portion. In this case, flying of sparks directly to the ground electrode is more effectively reduced.

(3) In the spark plug of the above-described mode, the intermediate tip may include a flange which is joined to the ground electrode, and a distance between a surface of the flange which faces toward the noble metal tip and the weld portion may be 10% or more of a distance between the surface of the flange and a gap-side end of the noble metal tip. In this case, a sufficient distance is provided between the flange of the intermediate tip and the weld portion. By using that portion of the intermediate tip, the intermediate tip can be easily joined to the ground electrode.

(4) A spark plug according to another mode of the present invention comprises an insulator having an axial hole extending along an axial line; a center electrode disposed in the axial hole; a tubular metallic shell surrounding the insulator; a ground electrode whose proximal end is fixed to the metallic shell; and a first noble metal tip which is fixed to a forward end of the center electrode so as to form a gap between the noble metal tip and the ground electrode, wherein a weld portion is provided between the noble metal tip and the center electrode. In the spark plug, the weld portion has a diameter larger than that of a portion of the center electrode which is adjacent to the weld portion. According to the spark plug of this mode, the weld portion between the noble metal tip and the center electrode has a large diameter. As a result, flying of sparks directly to the center electrode, which is an electrode component, can be restrained.

(5) In the spark plug of the above-described mode, a second noble metal tip may be disposed on the ground electrode, and the first noble metal tip may be located inside a virtual tapered cylindrical surface which extends from a peripheral edge of a gap-side end of the second noble metal tip so as to contact an outer circumferential edge of the weld portion. In this case, flying of sparks directly to the center electrode is more effectively reduced.

(6) In the spark plug of the above-described mode, over the entirety of a circumference of the weld portion, the diameter of the weld portion may be larger than the diameter of the portion of the center electrode which is adjacent to weld portion. In this case, flying of sparks directly to the center electrode is more effectively reduced.

The present invention can be realized in other various forms other than the spark plug. For example, the present invention can be realized as a method of manufacturing a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. First Embodiment

Figure 1:
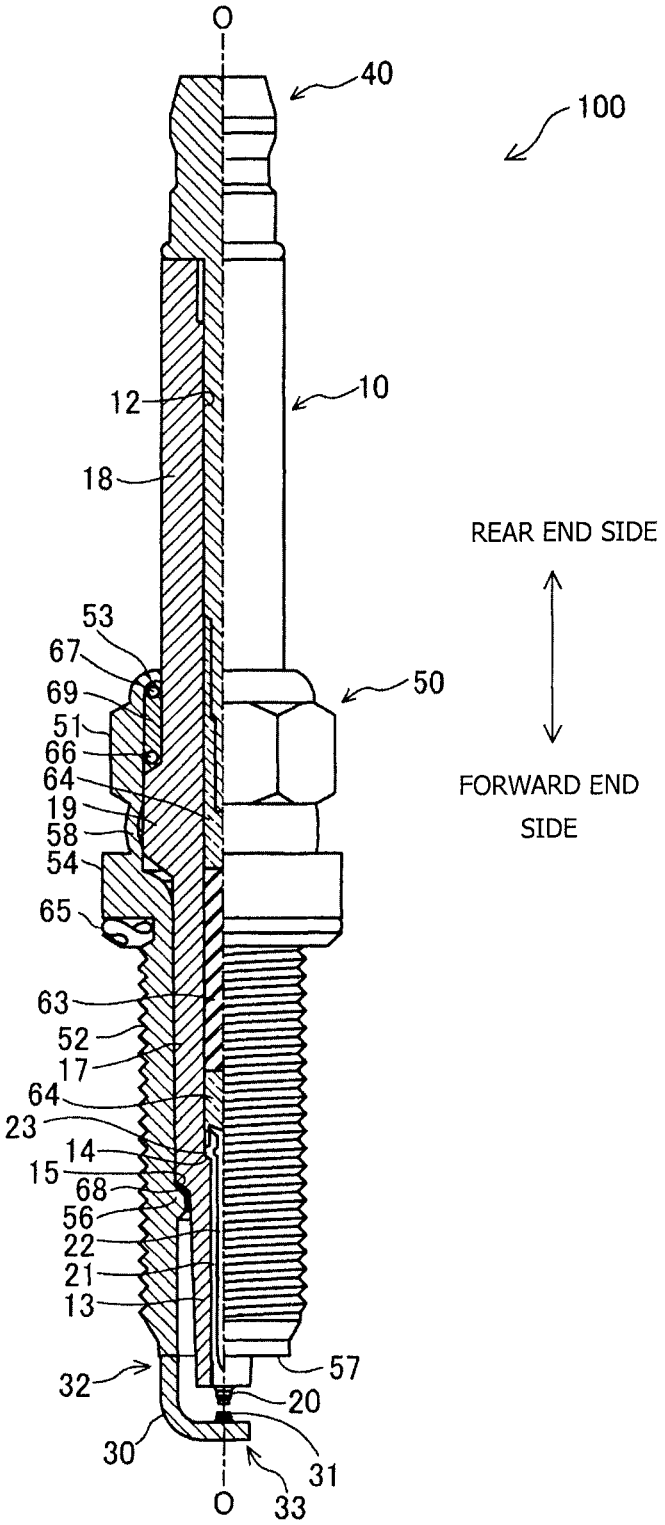
FIG. 1 is a partial cross sectional view of a spark plug according to a first embodiment.

FIG. 1 is a partial cross sectional view of a spark plug 100 according to a first embodiment of the present invention.

The spark plug 100 has an elongated shape along an axial line O. In FIG. 1, the right side of the axial line O, which is indicated by the long dashed short dashed line, shows an external front view, and the left side of the axial line O shows a cross sectional view taken along the axial line O. In the following description, the lower side of the FIG. 1 is referred to as a forward end side of the spark plug 100, and the upper side of FIG. 1 is referred to as a rear end side.

The spark plug 100 includes an insulator 10 having an axial hole 12 extending along the axial line O, a center electrode 20 disposed in the axial hole 12, a tubular metallic shell 50 which surrounds the insulator 10, and a ground electrode 30 whose proximal end 32 is fixed to the metallic shell 50.

The insulator 10 is a ceramic insulator formed by firing a ceramic material such as alumina. The insulator 10 is a tubular member having the axial hole 12 at its center. The forward end side of the axial hole 12 accommodates a portion of the center electrode 20 and the rear end side of the axial hole 12 accommodates a portion of a metal terminal 40. A central trunk portion 19 having an increased outer diameter is formed on the insulator 10 at the center in the axis direction. A rear trunk portion 18 having an outer diameter smaller than that of the central trunk portion 19 is formed on the rear end side of the central trunk portion 19. A forward trunk portion 17 having an outer diameter smaller than that of the rear trunk portion 18 is formed on the forward end side of the central trunk portion 19. A leg portion 13 having an outer diameter smaller than that of the forward trunk portion 17 and decreasing toward the center electrode 20 is formed on the forward end side of the forward trunk portion 17.

The metallic shell 50 is a cylindrical tubular metal member which surrounds and holds a portion of the insulator 10, from a portion of the rear trunk portion 18 to the leg portion 13. The metallic shell 50 is made of, for example, low-carbon steel, and entirely plated with nickel, zinc or the like. The metallic shell 50 includes a tool engagement portion 51, a seal portion 54 and a mounting screw portion 52, which are disposed in this order from the rear end side. A tool for mounting the spark plug 100 on an engine head is fitted on the tool engagement portion 51. The mounting screw portion 52 has threads which are threaded into a mounting screw hole of the engine head. The seal portion 54 is formed in a flange shape at the proximal end of the mounting screw portion 52. An annular gasket 65 formed by bending a plate is inserted between the seal portion 54 and the engine head. The metallic shell 50 has, at its forward end, an annular end surface 57 which surrounds a center opening of the metallic shell 50. The forward end of the leg portion 13 of the insulator 10 and the forward end of the center electrode 20 project from the center opening.

A crimp portion 53 having a reduced thickness is provided on the rear end side of the tool engagement portion 51 of the metallic shell 50. Further, a compression deformation portion 58 having a reduced thickness like the crimp portion 53 is provided between the seal portion 54 and the tool engagement portion 51. Annular ring members 66 and 67 are disposed between a portion of the inner circumferential surface of the metallic shell 50 extending from the tool engagement portion 51 to the crimp portion 53 and the outer circumferential surface of the rear trunk portion 18 of the insulator 10. Powder of talc 69 is charged between the two ring members 66 and 67. At the time of manufacture of the spark plug 100, the crimp portion 53 is pressed forward so that the crimp portion 53 is bent inward, thereby allowing the compression deformation portion 58 to be deformed by compression. As the compression deformation portion 58 is deformed by compression, the insulator 10 is pressed forward in the metallic shell 50 via the ring members 66, 67 and the talc 69. As a result of this pressing, the talc 69 is compressed in the direction of the axial line O, thereby increasing airtightness in the metallic shell 50.

The insulator 10 is disposed in the metallic shell 50. Specifically, an insulator step portion 15 of the insulator 10 located at the rear end of the leg portion 13 thereof is pressed against a metallic shell step portion 56 formed on the inner circumference of the mounting screw portion 52 via an annular sheet packing 68. This sheet packing 68 is a member that maintains airtightness between the metallic shell 50 and the insulator 10, and prevents leakage of combustion gas.

The center electrode 20 is a rod shaped member formed by embedding a core material 22 in an electrode member 21 with the core material 22 having a thermal conductivity higher than that of the electrode member 21. The electrode member 21 is made of a nickel alloy which contains nickel as a main component, and the core material 22 is made of copper or an alloy which contains copper as a main component. The center electrode 20 has a diameter of, for example, 0.9 mm at its forward end.

The center electrode 20 has a flange 23 formed near the rear end thereof and bulging outward. The flange 23 comes into contact with an axial hole step portion 14 formed in the axial hole 12 from the rear end side to thereby position the center electrode 20 in the insulator 10. The rear end of the center electrode 20 is electrically connected to the metal terminal 40 via a seal 64 and a ceramic resistor 63.

The ground electrode 30 is made of an alloy which contains nickel as a main component. The proximal end 32 of the ground electrode 30 is fixed to the end surface 57 of the metallic shell 50. The ground electrode 30 extends forward from the proximal end 32 along the axial line O, and is curved at an intermediate portion such that one side surface of a distal end portion 33 faces the forward end surface of the center electrode 20. In the present embodiment, a noble metal tip 31 in a cylindrical shape is disposed on a surface of the distal end portion 33 of the ground electrode 30 which faces the center electrode 20. The diameter of the noble metal tip 31 is, for example, 1.0 mm. The noble metal tip 31 forms a gap between the noble metal tip 31 and the center electrode 20 for spark discharge. The gap is, for example, 0.8 mm. The noble metal tip 31 is made of, for example, platinum (Pt), iridium (Ir), ruthenium (Ru), rhodium (Rh), or an alloy thereof.

Figure 2:
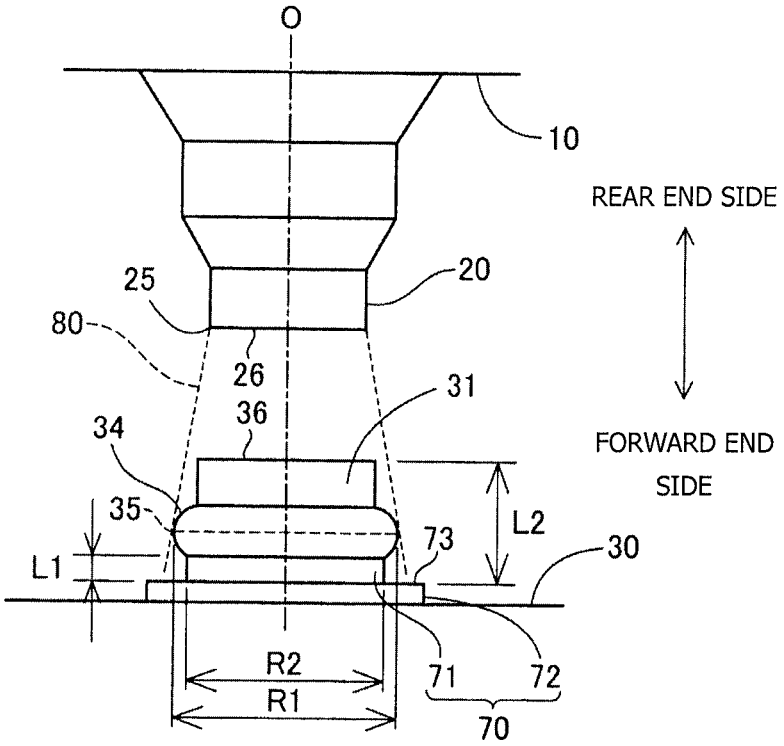
FIG. 2 is an enlarged view of a noble metal tip and a center electrode.

FIG. 2 is an enlarged view of the noble metal tip 31 and the center electrode 20. The noble metal tip 31 is fixed to the ground electrode 30 via an intermediate tip 70. In the present embodiment, the surface of a gap-side end 36 of the noble metal tip 31 and the surface of a gap-side end 26 of the center electrode 20 are approximately parallel to each other. Further, the center axis of the noble metal tip 31 extends through the surface of the gap-side end 26 of the center electrode 20, and the center axis of the center electrode 20 extends through the surface of the gap-side end 36 of the noble metal tip 31. In the present embodiment, the center axis of the noble metal tip 31 and the center axis of the center electrode 20 coincide with each other and with the axial line O. Further, in another embodiment, the center axis of the noble metal tip 31 and the center axis of the center electrode 20 may be offset from each other. Moreover, the center axis of the noble metal tip 31 and the center axis of the center electrode 20 may intersect with each other or may be in a skew relation.

The intermediate tip 70 is made of the same material as that of the ground electrode 30. The intermediate tip 70 has a cylindrical straight portion 71 and a flange 72. The diameter of the straight portion 71 is, for example, 1.1 mm. The flange 72 is disposed at the forward end of the straight portion 71. The noble metal tip 31 is laser-welded to the straight portion 71 of the intermediate tip 70. The intermediate tip 70 with the noble metal tip 31 joined thereto is joined to the ground electrode 30 by resistance-welding the flange 72 to the ground electrode 30 while pressing the flange 72 for contact with the ground electrode 30. A weld portion 34 is present between the noble metal tip 31 and the intermediate tip 70. The weld portion 34 is formed by materials of the noble metal tip 31 and the intermediate tip 70 which are melted during laser welding and then solidified. The maximum diameter R1 of the weld portion 34 is, for example, 1.3 mm. The flange 72 may not be necessarily provided.

In the present embodiment, the weld portion 34 bulges outward. This bulge is formed, for example, by using a centrifugal force by rotating the noble metal tip 31 and the intermediate tip 70 while continuously irradiating the outer peripheries of the noble metal tip 31 and the intermediate tip 70 with a laser beam. Alternatively, the bulge can be formed by applying a load to the noble metal tip 31 and the intermediate tip 70 such that the noble metal tip 31 and the intermediate tip 70 are compressed during joining of the noble metal tip 31 and the intermediate tip 70.

In the present embodiment, over the entire circumference of the weld portion 34, the diameter R1 of the weld portion 34 is larger than the diameter of a portion of the intermediate tip 70 which is adjacent to the weld portion 34, that is, the diameter R2 of the straight portion 71. Further, in the present embodiment, the noble metal tip 31 is entirely located inside a virtual tapered cylindrical surface 80 which extends from the peripheral edge 25 of the forward end of the center electrode 20 so as to come into contact with the outer circumferential edge 35 of the weld portion 34. The virtual tapered cylindrical surface 80 is a virtual surface formed by connecting the peripheral edge 25 of the forward end of the center electrode 20 and the outer circumferential edge 35 of the weld portion 34 by straight lines over the entire circumferences thereof.

Further, in the present embodiment, the distance L1 between the weld portion 34 and a surface 73 of the flange 72 which faces toward the noble metal tip 31, that is, the distance L1 of the straight portion 71, is 10% or more of the distance L2 between the surface 73 of the flange 72 and the gap-side end 36 of the noble metal tip 31.

In the aforementioned spark plug 100 of the present embodiment, the diameter R1 of the weld portion 34 is larger than the diameter R2 of the straight portion 71. Accordingly, when sparks flow due to, for example, a high flow velocity of an air-fuel mixture in a cylinder of the internal combustion engine for which the spark plug is provided, sparks are more likely to fly to the weld portion 34 rather than to the electrode components such as the intermediate tip 70 and the ground electrode 30 compared with the case where the diameter R1 of the weld portion 34 is similar to the diameter R2 of the straight portion 71 (the case where the weld portion 34 does not bulge outward). Therefore, sparks are less likely to fly to the electrode components such as the intermediate tip 70 and the ground electrode 30, which are spaced from the noble metal tip 31 by a greater distance, compared with the weld portion 34. Thus, consumption (erosion) of the electrode components can be reduced. In addition, since the weld portion 34 contains the component of the noble metal tip 31, the weld portion 34 is more durable than the electrode components. Accordingly, even if sparks fly to the weld portion 34, the amount of consumption can be decreased compared with the case where sparks fly to the electrode components.

In the present embodiment, the noble metal tip 31 is located inside the virtual tapered cylindrical surface 80 which extends from the peripheral edge 25 of the forward end of the center electrode 20 so as to come into contact with the outer circumferential edge 35 of the weld portion 34. Accordingly, when sparks flow due to, for example, a high flow velocity of an air-fuel mixture in a cylinder of the internal combustion engine for which the spark plug is provided, sparks are more likely to fly to the weld portion 34 compared with the case where the noble metal tip 31 is partially present outside the virtual tapered cylindrical surface 80. Therefore, flying of sparks directly onto the electrode material is more effectively reduced.

In the present embodiment, over the entire circumference of the weld portion 34, the diameter R1 of the weld portion 34 is larger than the diameter R2 of the straight portion 71. Accordingly, flying of sparks directly to the electrode component is more effectively reduced.

In the present embodiment, since the length L1 of the straight portion 71 is 10% or more of the distance L2 between the surface 73 of the flange 72 and the gap-side end 36 of the noble metal tip 31, the straight portion 71 can be made sufficiently long. Accordingly, the intermediate tip 70 can be easily resistance-welded to the ground electrode 30 by using the straight portion 71 and the surface 73 of the flange 72.

In the above embodiment, over the entire circumference of the weld portion 34, the diameter R1 of the weld portion 34 is larger than the diameter R2 of the straight portion 71. However, the diameter R1 of the weld portion 34 may be larger than the diameter R2 of the straight portion 71 only over a portion of the circumference of the weld portion 34. When the diameter R1 of the weld portion 34 is larger than the diameter R2 of the straight portion 71 only over a portion of the circumference of the weld portion 34, flying of sparks directly to the electrode component can prevented in a region corresponding to that portion of the circumference of the weld portion 34.

In the above embodiment, the length L1 of the straight portion 71 is 10% or more of the distance L2 between the surface 73 of the flange 72 and the gap-side end 36 of the noble metal tip 31. However, the length L1 of the straight portion 71 may be less than 10% of the distance L2 as far as the intermediate tip 70 can be joined to the ground electrode 30.

B. Second Embodiment

Figure 3:
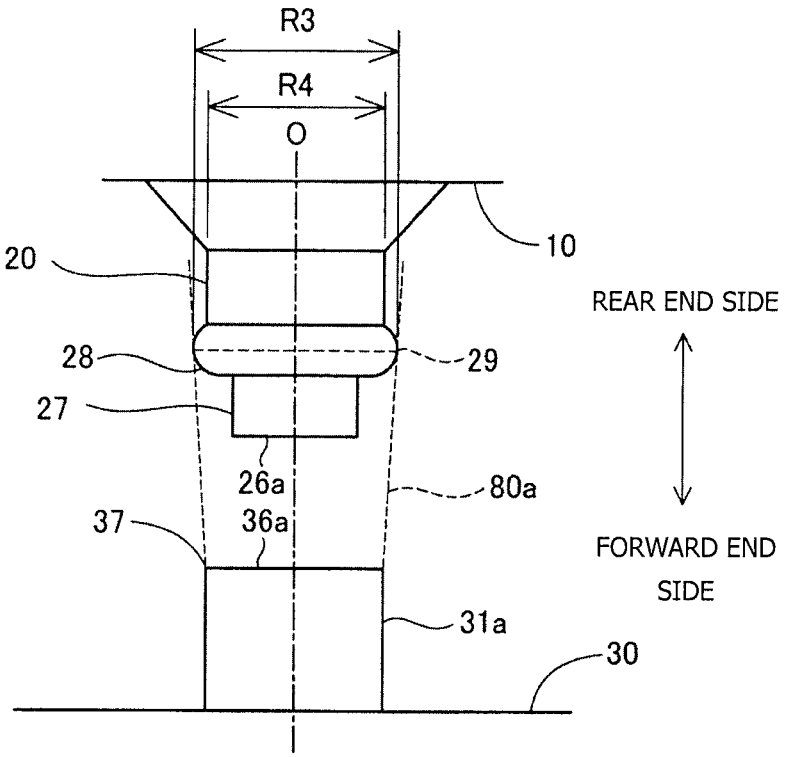
FIG. 3 is an enlarged view of a center electrode according to a second embodiment.

FIG. 3 is an enlarged view of the center electrode 20 in a spark plug according to a second embodiment of the present invention. The spark plug of the second embodiment has the same structure as that of the spark plug of the first embodiment except for the structures of the center electrode and the ground electrode.

In the spark plug of the second embodiment, a noble metal tip 27 in a cylindrical shape is fixed to the forward end of the center electrode 20. The noble metal tip 27 forms a gap between the noble metal tip 27 and the ground electrode 30 for spark discharge. The diameter of the noble metal tip 27 is, for example, 0.7 mm. The center electrode 20 and the noble metal tip 27 are laser-welded. Accordingly, a weld portion 28 is present between the center electrode 20 and the noble metal tip 27. The maximum diameter R3 of the weld portion 28 is, for example, 1.2 mm. The diameter R4 of the portion of the center electrode 20 which is adjacent to the weld portion 28 is, for example, 1.0 mm.

In the present embodiment, a noble metal tip 31*a* in a cylindrical shape is directly joined to the ground electrode 30. The diameter of the noble metal tip 31*a* is, for example, 1.0 mm. The gap between the noble metal tip 31*a* and the noble metal tip 27 on the center electrode 20 is, for example, 0.8 mm. In the present embodiment, the noble metal tip 31*a* is resistance-welded to the ground electrode 30. The noble metal tip 31*a* may be fixed to the ground electrode 30 via an intermediate tip as in the case of the first embodiment.

In the present embodiment, the surface of a gap-side end 36*a* of the noble metal tip 31*a* and the surface of a gap-side end 26*a* of the noble metal tip 27 of the center electrode 20 are approximately parallel to each other. Further, the center axis of the noble metal tip 31*a* on the ground electrode 30 extends through the surface of the gap-side end 26*a* of the noble metal tip 27 on the center electrode 20, and the center axis of the noble metal tip 27 on the center electrode 20 extends through the surface of the gap-side end 36*a* of the noble metal tip 31*a* on the ground electrode 30. In the present embodiment, the center axis of the noble metal tip 31*a* on the ground electrode 30 and the center axis of the noble metal tip 27 on the center electrode 20 coincide with each other and with the axial line O. Further, in another embodiment, the center axis of the noble metal tip 31*a* on the ground electrode 30 and the center axis of the noble metal tip 27 on the center electrode 20 may be offset from each other. Moreover, the center axis of the noble metal tip 31*a* on the ground electrode 30 and the center axis of the noble metal tip 27 on the center electrode 20 may intersect with each other or may be in a skew relation.

In the present embodiment, the weld portion 28 bulges outward. Specifically, over the entire circumference of the weld portion 28, the diameter R3 of the weld portion 28 is larger than the diameter R4 of the portion of the center electrode 20 which is adjacent to the weld portion 28. Further, the noble metal tip 27 on the center electrode 20 is entirely located inside a virtual tapered cylindrical surface 80*a* which extends from the peripheral edge 37 of the gap-side end of the noble metal tip 31*a* on the ground electrode 30 so as to come into contact with the outer circumferential edge 29 of the weld portion 28.

In the aforementioned second embodiment, the diameter R3 of the weld portion 28 is larger than the diameter R4 of the portion of the center electrode 20 which is adjacent to the weld portion 28. Accordingly, when sparks flow due to, for example, a high flow velocity of an air-fuel mixture in the cylinder of the internal combustion engine, sparks are more likely to fly to the weld portion 29 rather than to the electrode component (center electrode 20) compared with the case where the diameter R3 of the weld portion 28 is similar to the diameter R4 of the portion adjacent to the weld portion 28 (the case where the weld portion 28 does not bulge outward). Therefore, sparks are less likely to fly to the electrode component which is spaced from the noble metal tip 31*a* by a greater distance compared with the weld portion 29. Thus, consumption of the center electrode 20, which is an electrode component, can be reduced.

In the present embodiment, the noble metal tip 27 on the center electrode 20 is located inside the virtual tapered cylindrical surface 80*a* which extends from the peripheral edge 37 of the gap-side end of the noble metal tip 31*a* on the ground electrode 30 so as to come into contact with the outer circumferential edge 29 of the weld portion 28. Accordingly, when sparks flow due to, for example, a high flow velocity of an air-fuel mixture in the cylinder of the internal combustion engine, sparks are more likely to fly to the weld portion 28 compared with the case where the noble metal tip 27 on the center electrode 20 is partially present outside the virtual tapered cylindrical surface 80*a*. Therefore, flying of sparks directly to the electrode component is more effectively reduced. In the present embodiment, over the entire circumference of the weld portion 28, the diameter R3 of the weld portion 28 is larger than the diameter R4 of the portion of the center electrode 20 which is adjacent to the weld portion 28. Accordingly, flying of sparks directly to the center electrode 20 is effectively reduced.

In the second embodiment, over the entire circumference of the weld portion 28, the diameter R3 of the weld portion 28 is larger than the diameter R4 of the portion of the center electrode 20 which is adjacent to the weld portion 28. However, the diameter of the weld portion 28 may be larger, only over a portion of the circumference of the weld portion 28, than the diameter of the portion of the center electrode 20 which is adjacent to the weld portion 28. When the diameter of the weld portion 28 is larger, only over a portion of the circumference of the weld portion 28, than the diameter of the portion of the center electrode 20 which is adjacent to the weld portion 28, flying of sparks directly to the center electrode 20 can be restrained in a region corresponding to that portion of the circumference of the weld portion 28.

The present invention is not limited to the above-described embodiments and may be embodied in various other forms without departing from the scope of the invention. For example, the technical features in the embodiments corresponding to the technical features in the modes described in "Summary of the Invention" can be appropriately replaced or combined in order to solve some of or all the foregoing problems or to achieve some of or all the foregoing effects. A technical feature which is not described as an essential feature in the present specification may be appropriately deleted.

DESCRIPTION OF SYMBOLS

10 . . . insulator
12 . . . axial hole
13 . . . leg portion
14 . . . axial hole step portion
15 . . . insulator step portion
17 . . . forward trunk portion
18 . . . rear trunk portion
19 . . . central trunk portion
20 . . . center electrode
21 . . . electrode member
22 . . . core material
23 . . . flange
25 . . . peripheral edge of forward end
26, 26*a* . . . gap-side end
27 . . . (first) noble metal tip
28 . . . weld portion
29 . . . outer circumferential edge
30 . . . ground electrode
31, 31*a* . . . noble metal tip (second noble metal tip)
32 . . . proximal end
33 . . . distal end portion
34 . . . weld portion
35 . . . outer circumferential edge
36, 36*a* . . . gap-side end
37 . . . peripheral edge of gap-side end

40 . . . metal terminal
50 . . . metallic shell
51 . . . tool engagement portion
52 . . . mounting screw portion
53 . . . crimp portion
54 . . . seal portion
56 . . . metallic shell step portion
57 . . . end surface
58 . . . compression deformation portion
63 . . . ceramic resistor
64 . . . seal
65 . . . gasket
66, 67 . . . ring member
68 . . . sheet packing
69 . . . talc
70 . . . intermediate tip
71 . . . straight portion
72 . . . flange
73 . . . surface
80, 80*a* . . . virtual tapered cylindrical surface
100 . . . spark plug

The invention claimed is:

1. A spark plug comprising:
an insulator having an axial hole extending along an axial line of the spark plug;
a center electrode disposed in the axial hole;
a tubular metallic shell surrounding the insulator;
a ground electrode whose proximal end is fixed to the metallic shell; and
a cylindrical noble metal tip which is fixed to the ground electrode via an intermediate tip so as to form a gap between the noble metal tip and the center electrode, wherein
a weld portion is provided between the noble metal tip and the intermediate tip,
the weld portion has a diameter larger than that of a portion of the intermediate tip which is adjacent to the weld portion,
the noble metal tip is entirely located inside a virtual tapered cylindrical surface, which extends from a peripheral edge of a gap-side end of the center electrode so as to contact an outer circumferential edge of the weld portion, and
the weld portion has a bulge portion that bulges outward in a radial direction of the spark plug from the portion of the intermediate tip.

2. The spark plug according to claim 1, wherein, over an entirety of a circumference of the weld portion, the diameter of the weld portion is larger than the diameter of the portion of the intermediate tip which is adjacent to the weld portion.

3. The spark plug according to claim 1, wherein
the intermediate tip includes a flange, which is joined to the ground electrode, and
a distance between a surface of the flange which faces toward the noble metal tip and the weld portion is 10% or more of a distance between the surface of the flange and a gap-side end of the noble metal tip.

4. A spark plug comprising:
an insulator having an axial hole extending along an axial line of the spark plug;
a center electrode disposed in the axial hole;
a tubular metallic shell surrounding the insulator;
a ground electrode whose proximal end is fixed to the metallic shell; and
a first noble metal tip which is fixed to a forward end of the center electrode so as to form a gap between the first noble metal tip and the ground electrode, wherein
a weld portion is provided between the first noble metal tip and the center electrode,
the weld portion has a diameter larger than that of the first noble metal tip and a base portion of the center electrode which is adjacent to the weld portion, and
the base portion has a constant diameter and has an outer surface that extends parallel to the axial line.

5. The spark plug according to claim 4, wherein
a second noble metal tip is disposed on the ground electrode, and
the first noble metal tip is located inside a virtual tapered cylindrical surface, which extends from a peripheral edge of a gap-side end of the second noble metal tip so as to contact an outer circumferential edge of the weld portion.

6. The spark plug according to claim 4, wherein, over an entirety of a circumference of the weld portion, the diameter of the weld portion is larger than the diameter of the portion of the center electrode which is adjacent to weld portion.

7. The spark plug according to claim 2, wherein, over an entirety of a circumference of the weld portion, the diameter of the weld portion is larger than the diameter of the portion of the intermediate tip which is adjacent to the weld portion.

8. The spark plug according to claim 5, wherein, over an entirety of a circumference of the weld portion, the diameter of the weld portion is larger than the diameter of the portion of the center electrode which is adjacent to weld portion.

9. The spark plug according to claim 1, wherein the weld portion has a bulge portion that bulges outward in a radial direction of the spark plug.

10. The spark plug according to claim 4, wherein the weld portion has a bulge portion that bulges outward in a radial direction of the spark plug.

11. The spark plug according to claim 1, wherein the weld portion is not provided in the center electrode.

* * * * *